US005230508A

United States Patent [19]

Tabler

[11] Patent Number: 5,230,508

[45] Date of Patent: Jul. 27, 1993

[54] JIGSAW PUZZLE

[76] Inventor: Charles P. Tabler, 10832 Kristiridge Dr., Cincinnati, Ohio 45252

[21] Appl. No.: 820,000

[22] Filed: Jan. 13, 1992

[51] Int. Cl.[5] ..... A63F 9/12

[52] U.S. Cl. ..... 273/157 R; 273/160

[58] Field of Search ..... 273/157 R, 160

[56] References Cited

U.S. PATENT DOCUMENTS

| | | | |
|---|---|---|---|
| D. 138,214 | 7/1944 | Miller | 273/157 R |
| D. 215,949 | 11/1969 | Markusen | 273/160 |
| D. 243,783 | 3/1977 | Kleinman et al. | 273/157 R |
| 343,516 | 6/1886 | Collins et al. | 273/160 |
| 2,201,724 | 5/1940 | Gable | 273/160 |
| 2,445,421 | 7/1948 | Davis | 273/157 R |
| 3,829,101 | 8/1974 | Betzoldt | 273/160 |
| 3,918,178 | 11/1975 | Riley | 273/156 |
| 4,428,732 | 1/1984 | Meyer | 273/157 R |
| 4,805,918 | 2/1989 | Feinberg | 273/157 R |

FOREIGN PATENT DOCUMENTS

| | | | |
|---|---|---|---|
| 3500840 | 7/1986 | Fed. Rep. of Germany | 273/157 R |
| 2258208 | 8/1975 | France | 273/160 |
| 244016 | 12/1925 | United Kingdom | 273/160 |
| 1242942 | 8/1971 | United Kingdom | 273/160 |

OTHER PUBLICATIONS

Gift & Decorative Accessories, Dec., 1978, p. 239.

Suburbia Mail Shopping Service, Mar. 1978, p. 74.

*Primary Examiner*—V. Millin

*Assistant Examiner*—Steven B. Wong

*Attorney, Agent, or Firm*—Fay, Sharpe, Beall, Fagan, Minnich & McKee

[57] ABSTRACT

The jigsaw puzzle requires assembly and disassembly with a sequence of assembling. The configuration, as viewed parallel to one axis, is individualized as a trace indicia. As cuts are made, pieces are disassembled and cut so that the last cut line extends into a previous cut line, but not across the previous cut line because of the part being disassembled.

6 Claims, 2 Drawing Sheets

JIGSAW PUZZLE

BACKGROUND OF THE INVENTION

While jigsaw puzzles have been known and enjoyed by a wide segment of our society for a very long period time, innovations in this art appear to be few. The degree of complexity appears to be primarily increased by providing a background pattern having portions less distinctive from each other, an increased number of pieces, a smaller size of the pieces, and a closer similarity among the individual cuts without making too many of them interchangeable. The degree of difficulty for individual puzzles appears to be geared towards age groups and ability levels by changing the above variables.

Quite apart from puzzles, there are areas where people like to have their possessions individualized, for example the so-called "vanity plates" for automobiles, monogrammed shirts, and the like.

While the term jigsaw puzzle was no doubt partly derived from the name of a particular type of cutting machine, namely the jigsaw, modern jigsaw puzzles are made by many different machines other than the traditional jigsaw, for example by stamping out flat sheets of material much in the way cookies are cut out from a flat sheet of dough by a cookie cutter. Therefore, the term jigsaw puzzle is more descriptive of the type of puzzle than the machine used to make the puzzle. Generally, jigsaw puzzles are thought of as being made from a flat sheet of material whose thickness is generally immaterial, which is cut into a number of pieces as viewed in a plan view so that the pieces can be vertically assembled/disassembled but interlocked to prevent assembly/disassembly in any horizontal direction.

SUMMARY OF THE INVENTION

It is an object of the present invention to figuratively and literally add a whole new dimension to the traditional jigsaw puzzle. Degrees of difficulty, with this change in dimension, can be increased incrementally in large steps.

While traditional jigsaw puzzles are disassembled and put together along only one axis, for example the z or vertical axis of a sheet puzzle that extends in the x and y plane for Cartesian coordinates, the puzzle of the present invention also requires assembly and disassembly in one or more of additional axes, for example the x and y axis. The puzzle of the present invention may also be analyzed in accordance with other coordinate systems.

Traditional jigsaw puzzles have an independence of assembly sequence, that is any two pieces may generally be assembled without regard to the prior assembly of any other pieces. The present invention has an added degree of difficulty in that it requires a sequence of assembling the pieces. For example, it may be required that a first pair of pieces be assembled in the x direction and a second pair of pieces be assembled in the x direction to provide two assembled pair before a piece of one pair is assembled in another direction (for example the y or z direction) with a piece of the other pair; of course, these last mentioned two pieces of the two pair may be assembled first in such another direction, but thereafter they may not then be assembled with their pair mate.

It is a further object of the present invention to individualize a jigsaw puzzle. More specifically, the jigsaw puzzle is provided with a configuration, as viewed parallel to one axis, that is individualized, for example as a trace recognizable as the initial, or name of a person, individual, commercial or the like. More generally, the trace would be an indicia representing a word, words, thought or some other meaning in the same way that letters, syllables, characters, words, numerals and the like provide such representation. In the preferred embodiment, the trace is that of an individual's initials.

The thickness of the puzzle is cut with a jigsaw pattern in the same manner that the plan view of the puzzle is cut from the jigsaw pattern, and more preferably the thickness is cut with a jigsaw pattern in different directions. The number of directions changes the complexity in increments and the number of layers of cuts in the thickness direction changes the complexity in increments.

Further, as cuts are made, pieces are disassembled and cut so that the last cut line extends into a previous cut line, but not across the previous cut line because of the part being disassembled. Therefore, the parts must be assembled first in the last made groups of such cuts prior to the groups being assembled, that is, in general, assembly for this latter degree of difficulty must be in the reverse order of the cuts that were made.

While the term jigsaw is used and the jigsaw will be the preferred apparatus for forming the cut lines, it is recognized that other apparatus and cutting methods may be used to form the jigsaw puzzle, such as for example, a stamping type cutter (similar to a cookie cutter), a laser beam cutter, a pattern milling machine, or in fact no literal cuts may be made when the jigsaw puzzle has its individual pieces cast or molded. The term jigsaw, as used herein is merely a convenient term used to define the type of puzzle wherein individual pieces interlock to prevent their disassembly in at least one direction.

BRIEF DESCRIPTION OF THE DRAWINGS

Further objects, features and advantages of the present invention will become more clear from the following detailed description of a preferred embodiment, as shown in the accompanying drawing wherein.

DETAILED DESCRIPTION

Figure 1:
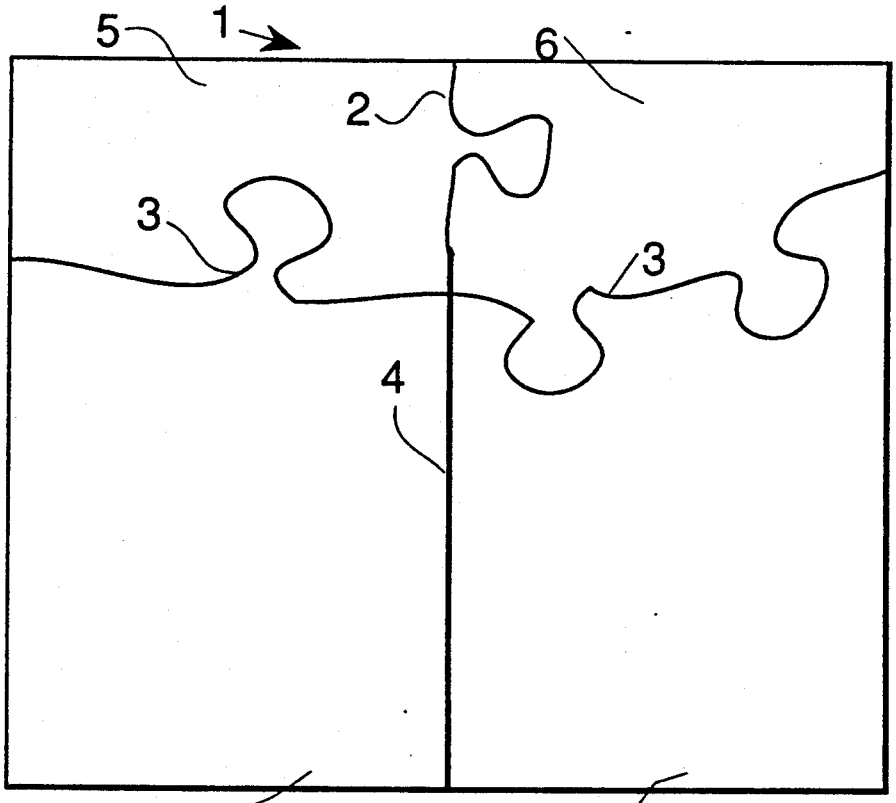
FIG. 1 is a plan view of a jigsaw puzzle produced as an intermediate stage of the preferred embodiment of the present invention.

As mentioned, jigsaw puzzles have been widely used, enjoyed and to some degree understood over a very long period of time. With such wide usage over a long period of time, it is understandable that there is considerable confusion with respect to terminology, and it would be expected that many people would differ in their understanding of specific terms used to describe jigsaw puzzles, and even more understandable that such people would be confused by terms used to describe the very different concepts of the jigsaw puzzle of the present invention. Therefore, a few terms that will be used herein will be set forth with definitions that will apply with respect to the present invention.

As mentioned the term jigsaw is meant to be limiting with respect to the type of puzzle with interlocking separate pieces preventing disassembly in at least one direction, and not meant to be limiting as to the apparatus or method used in manufacturing or forming of such a puzzle. Of course, some pieces may mate without interlocking.

The jigsaw puzzle is characterized by pieces that interlock along basically contacting mating surfaces. The mating surfaces are generally coextensive and unique to the two adjacent pieces. The unique requirement is not absolute since in fact two different pair may have identical mating surfaces and be interchangeable for the pairing, although they are certainly not interchangeable in position with respect to the overall puzzle.

Each of these surfaces is defined by a line moving in a locus that is not coextensive with the line. The line, here a cutting line, may be straight, for example when a jigsaw is used so that the cutting line corresponds to the cutting edge of the jigsaw, and the locus may be a non-linear line with undercuts that extends in a plane perpendicular to the cutting line. Alternatively, the cutting line may be a curved line, the locus plane may extend at some other angle than perpendicular, and undercuts may not be necessary with respect to the locus line.

A surface has two dimensions, length and breadth, but no thickness. The boundaries of a solid body are defined by surfaces, and in the present jigsaw puzzle, the puzzle comprises a plurality of individual pieces, each of which is a solid body. Each puzzle piece has its surfaces divided into a plurality of portions, specifically portions that are exposed when the puzzle is assembled and portions that are hidden when the puzzle is assembled. The hidden portions are in turn divided into individual mating portions. Each mating portion is coextensive with a single mirror image mating portion of another piece, part of a single mating portion of another piece, a plurality of mating portions of a corresponding plurality of other pieces that together form the mating surface of the one piece in whole or in part, and exclusively or in addition to one or more mating surfaces of other pieces.

The boundaries of surfaces are defined by lines, that is surfaces cut one another in lines. Therefore, in addition to the mentioned length and width of a surface, a surface has shape. In contrast, a line has the shape and length, but no width, breadth or thickness. A line is also defined as the intersection of two surfaces. Lines may be linear, or curved. A curve is a bent line without angles. While a strict definition of a curve is a line in which no three consecutive points are in the same straight or linear line. With reference to the present invention, a curved line will be a line at least a portion of which will define a curve, but which may also contain a linear portion.

The locus is the path of a point which moves in accordance with certain geometrical conditions. For example, the locus in a plane of a point always at the same distance from two other points in that plane is a straight line at right angles to and bisecting the straight line joining the points. Another example is a locus in a plane of a point always at the same distance from another spaced apart point in that plane is a circle. With respect to the present invention, a jigsaw locus will be the path of a point moving in a plane to define a curved line so that two dimensional geometric shapes separated along a cut surface defined by a cutting line moving along jigsaw locus can be moved apart in at most limited relative directions in the plane of the locus, and an undercut jigsaw locus would form two such geometric shapes that could not be moved apart in any direction in the plane of the locus.

In forming a traditional jigsaw puzzle from a flat sheet, the flat sheet being a solid with a thickness in the z direction and a patterned surface in a plane containing the x and y directions of a Cartesian coordinate system, the pattern surface is placed parallel to the table of a jigsaw, and the jigsaw blade cutting line is linear and extends in the z direction. The jigsaw blade is first moved relative to the sheet along a jigsaw locus that is a curved line in the x, y plane to cut the sheet into two pieces. Thereafter, the jigsaw blade is moved along another jigsaw locus contained in the x, y plane of the patterned surface to cut the two pieces into a total of four pieces, and this is repeated with successive cutting steps along individual different jigsaw loci until the desired degree of complexity is obtained. Usually, such jigsaw loci are undercut curves.

Therefore, a mating surface for a jigsaw puzzle may be defined as a cutting line moving along a jigsaw locus, which cutting line is not in the plane of the jigsaw locus. With respect to a jigsaw puzzle made with a jigsaw, the cutting line is a straight or linear line having only a single dimension, that is a defined length, which cutting line will be referred to as a linear cutting line when a jigsaw is used, although it is understood that it is possible to form a jigsaw puzzle with a curved cutting line.

With a preferred embodiment of the present invention, the jigsaw loci appear in at least two non-parallel planes. Preferably, the jigsaw loci appear in non-parallel planes that are in fact perpendicular to each other, and more preferably in three mutually non-parallel planes that can define a Cartesian coordinate system.

The personalized jigsaw puzzle has a plan view, in a plane of jigsaw loci, that has a trace defining one or more indicia, that is the plan view of the jigsaw puzzle has inner and outer boundaries that form a meaningful personalized representation, for example the initials of an individual or corporation.

DETAILED DESCRIPTION OF A PREFERRED EMBODIMENT

In FIG. 1, a rectangular solid block of material 1, for example wood, is cut into a plurality of pieces by apparatus, for example a jigsaw. First, the surface shown in the top plan view of FIG. 1 is placed parallel to the table of the jigsaw, and the jigsaw blade moves relative to the material 1 along a locus 2, having a straight line portion 4 and an undercut curved portion, to divide the material into two pieces. Thereafter, the two pieces are together cut by the jigsaw moving along the jigsaw locus 3 to divide the material 1 into four pieces 5, 6, 7, 8. It is to be understood that a jigsaw cut along the jigsaw locus 3 may be conducted prior to the cut along the jigsaw locus 2. While the cuts described above with respect to FIG. 1 partly form an embodiment of the present invention, these cuts in fact define a jigsaw puzzle that is of a conventional type wherein the jigsaw loci 2, 3 are contained in a single plane. It is to be noted that the parts 7 and 8 are joined by mating surfaces that are straight, without any undercut or motion limiting configuration, which cut can be used in the finished preferred embodiment of the present invention, although it is not shown in the illustration of the finished embodiment to follow, so long as at least one other mating surface of each of pieces 7, 8 is undercut to prevent relative movement of the pieces.

Figure 2:
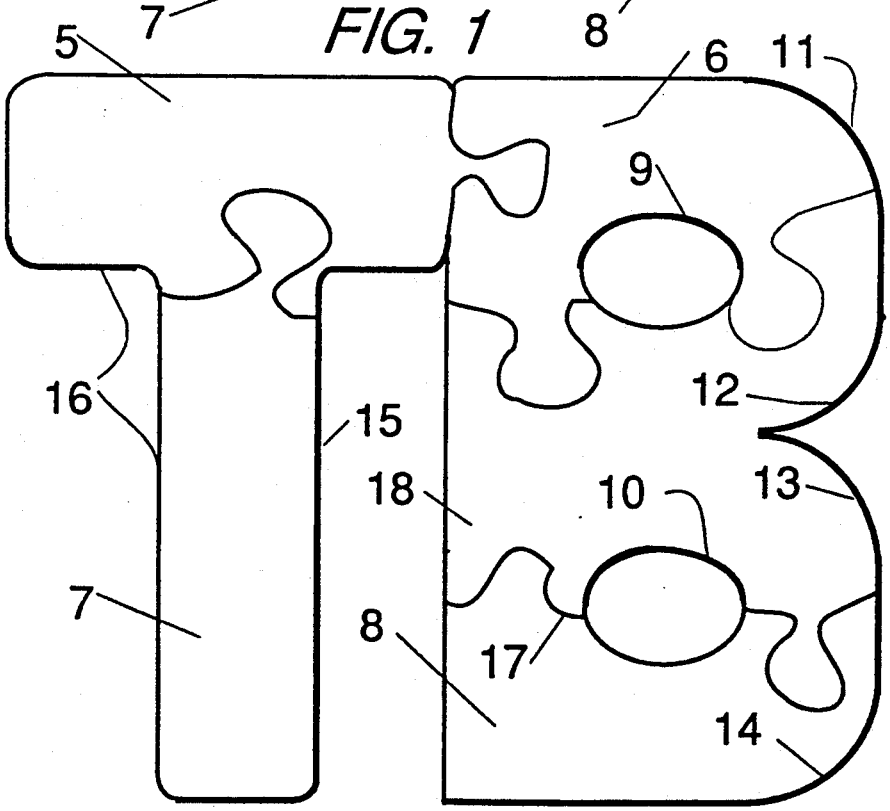
FIG. 2 is a plan view of an individualized jigsaw puzzle according to the present invention.

According to the present invention, the jigsaw puzzle can be personalized. In FIG. 2, the jigsaw puzzle of FIG. 1 has been cut along arcuate lines 11, 12, 13 and 14 as well as along interior oval lines 9 and 10, with cut off/out pieces removed, to form a B-shape. The puzzle has further been cut along lines 15 and 16 with cut off pieces removed to form a T-shape joining the B-shape, to provide an individual's initials. Corners are rounded or not according to preference.

It is to be understood that the cuts 11, 12, 13, 14, 15, 16 can be performed prior to the cuts along the loci 2, 3.

As shown in FIG. 2, the part 8 is further cut along locus 17 to form another part 18 out of the part 8.

While the initial puzzle of FIG. 2 forms a finished embodiment of the present invention by itself, it may be further cut according to another aspect of the present invention. By way of example, the T-shaped portion containing pieces 5, 7 will be additionally cut, with it being understood that the additional cuts are representative of similar additional cuts made to the B-shape portions 6, 8, 18.

Figure 3:
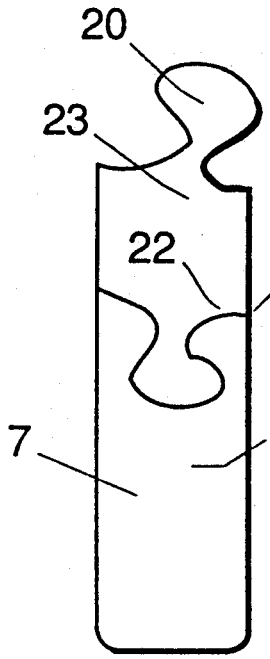
FIG. 3 is a plan view of a portion of the puzzle of FIG. 2 that is additionally cut.
Figure 4:
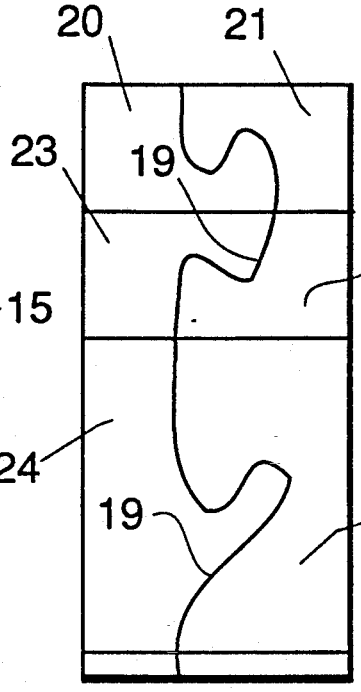
FIG. 4 is a right side elevational view of the portion shown in FIG. 3.
Figure 5:
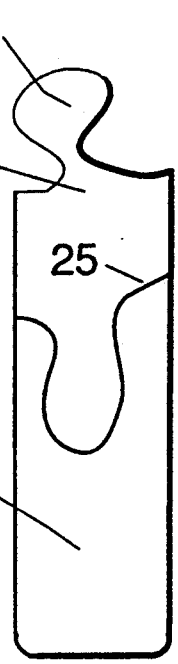
FIG. 5 is a bottom plan view of the portion shown in FIG. 3.
Figure 6:
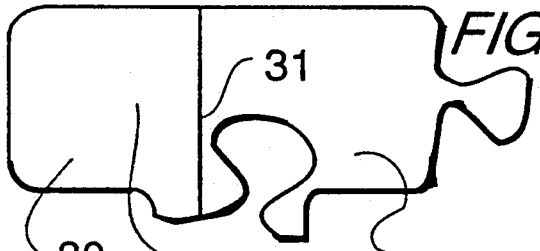
FIG. 6 is a top plan view of another portion of the puzzle shown in FIG. 2.

In FIGS. 3–5, the portion 7 from FIG. 2 is first cut along jigsaw locus 19, which locus 19 is in a plane at right angles to the plane of loci 2, 3, that is FIG. 4 is in a plane extending at right angles to the plane of FIGS. 1–3. An angle other than a right angle and substantially greater than 0 may be employed. The cut along locus 19 divides portion 7 into parts 20 and 21.

Thereafter, the part 20 is removed from the part 21, which removal is critical to one aspect of the present invention and rotated to the position shown in FIG. 3, which rotation is critical to the one aspect of the present invention. As shown in FIG. 3, the piece 20 is cut along jigsaw locus 22 to subdivide part 20 into parts 23 and 24. Similarly, part 21 is rotated 90 degrees from its position in FIG. 4 to its position in FIG. 5 and then cut along jigsaw locus 25 to subdivide the part 21 into parts 26 and 27.

It will be seen that part 26 can be assembled with part 23 and part 27 can be assembled with part 24 to form two pair of parts, namely pair 23, 26 and pair 24, 27, but these two pair cannot then be assembled with each other, because jigsaw locus 25 is different from jigsaw locus 22. Therefore, assembly must be in the reverse order of cutting with the jigsaw. Namely, as a first step parts 26 and 27 must be assembled and parts 23 and 24 must be assembled, so that two pair of parts, namely 26, 27 and 23, 24 are formed. Then as a second step these two pair can be assembled along mating surfaces formed by the jigsaw locus 19.

Figure 7:
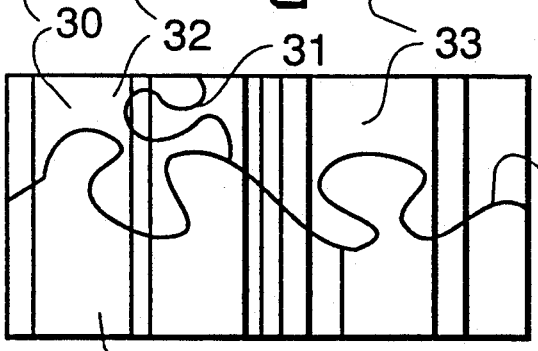
FIG. 7 is one side elevational view of the portion of the puzzle shown in FIG. 6.
Figure 8:
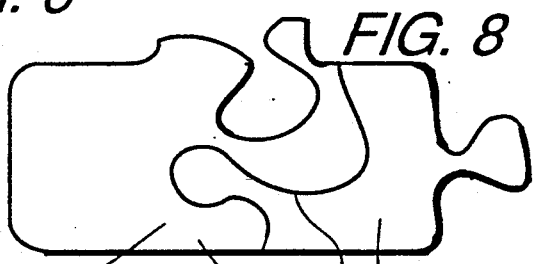
FIG. 8 is a bottom plan view of the portion of the puzzle shown in FIG. 6.
Figure 9:
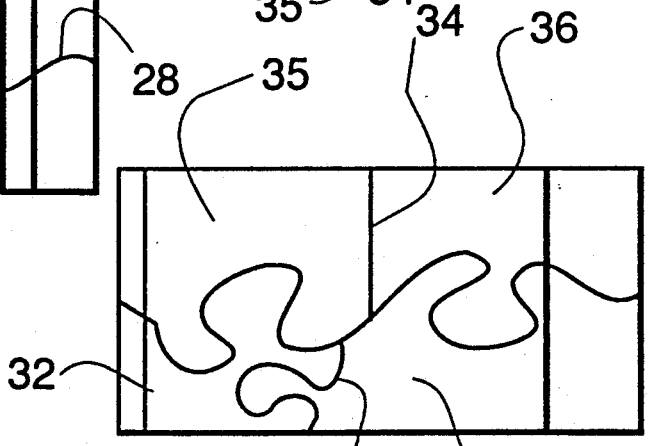
FIG. 9 is the other side elevational view of the portion of the puzzle shown in FIG. 6.

The part 5 of FIG. 2 is disassembled from its adjacent parts 6, 7 and further cut as shown in FIGS. 6–9. First, as shown in FIG. 7, the part 5, from its position in FIG. 1, is rotated through an angle, for example 90 degrees, and placed on the table of the jigsaw. It is then moved relative to the jigsaw blade so that the jigsaw blade moves along locus 28 to subdivide the part 5 into parts 29 and 30 having opposed mating surfaces defined by the jigsaw cutting line moving through the locus 28. The locus 28 is contained within a plane at right angles to the plane of FIGS. 1, 2, 3, 5, 6 and further at right angles to the plane of FIG. 4. Therefore, it is seen that the three loci 3, and 28 are contained respectively in three mutually perpendicular planes, for example the x, y plane, the x, z plane and the y, z plane of a Cartesian coordinate system.

Thereafter, parts 29 and 30 are disassembled.

Part 30 is then cut by moving the jigsaw cutting line along jigsaw locus 31 to subdivide the part 30 into parts 32, 33. The loci 28 and 31 are contained in the same plane, that is the plane of FIG. 7. Further, the part 29, removed from the part 30, is cut by the jigsaw blade moving along the locus 34, which locus 34 is in the plane of FIG. 8 that is parallel to the plane of FIG. 6, so that the part 29 is subdivided into parts 35, 36. Therefore, parts 35 and 36 must be assembled to form part 29 prior to assembly with part 30. Similarly, parts 32, 33 must be assembled to form part 30 prior to assembly with part 29.

In a similar manner, each of the parts 8, 18 and 6 forming the B-shape in FIG. 2 can be disassembled from the other parts and cut along a jigsaw locus in a plane other than the plane of FIG. 2 to subdivide the parts 8, 18, 6 to form subdivided parts that may further be disassembled individually and thereafter individually cut along jigsaw loci in planes at any angle with respect to the plane of FIG. 2, other than 0, and at any angle, other than 0, with respect to the planes of the other loci. Further and further subdivisions may be made, disassembled and further cut to form layers. Thus, the complexity increases with the number of required disassembly and cutting steps that are performed in tandem rather than parallel.

While a preferred embodiment has been set forth along with modifications and variations to show specific advantageous details of the present invention, further embodiments, modifications and variations are contemplated within the broader aspects of the present invention, all as set forth by the spirit and scope of the following claims.

I claim:

1. A jigsaw puzzle, comprising:

a plurality of separable solid pieces, adjacent pieces being joinable along undercut mating jigsaw surface pairs defined by respective different plural cutting lines, and each cutting line moving through a respective jigsaw locus so that said pieces when joined form a single solid;

at least some of said mating jigsaw surface pairs each being defined by a cutting line moving along a jigsaw locus that is in a first plane;

others of said mating jigsaw surface pairs each being defined by respective cutting lines moving along respective jigsaw loci contained in a common second plane angularly related to the first plane; one first pair of said others of said mating jigsaw surface pairs forming a first puzzle portion and a second puzzle portion that can only be assembled by relative movement in a direction perpendicular to said second plane;

at least one second pair of said some of said mating jigsaw surface pairs extending entirely through said first puzzle portion and through only one surface of said first pair without extending into said second puzzle portion to form a first and a second one of said pieces that can only be assembled by relative movement in a direction perpendicular to said first plane; and said first and second jigsaw surface pairs being means for requiring said pieces only be assembled in order of assembling said first and second pieces before assembling said first and second puzzle portions.

2. The jigsaw according to claim 1, wherein said planes are orthogonally related.

3. The jigsaw according to claim 2, wherein there are three of said planes orthogonally related to each other.

4. The jigsaw according to claim 1, wherein the pieces, when assembled, having a trace that forms letters, and each letter is subdivided along at least one jigsaw locus.

5. The jigsaw according to claim 4, wherein said planes are orthogonally related.

6. The jigsaw according to claim 5, wherein there are three of said planes orthogonally related to each other.

* * * * *